US009898892B2

(12) United States Patent
Peterson et al.

(10) Patent No.: US 9,898,892 B2
(45) Date of Patent: Feb. 20, 2018

(54) SYSTEM AND METHOD OF MODIFYING ATTRIBUTE VALUES OF GAME ENTITIES BASED ON PHYSICAL TOKEN DETECTION

(71) Applicant: DISNEY ENTERPRISES, INC., Burbank, CA (US)

(72) Inventors: Derek Peterson, Burbank, CA (US); Sandeep Kharkar, Burbank, CA (US)

(73) Assignee: Disney Enterprises, Inc., Burbank, CA (US)

( * ) Notice: Subject to any disclaimer, the term of this patent is extended or adjusted under 35 U.S.C. 154(b) by 7 days.

(21) Appl. No.: 15/008,722

(22) Filed: Jan. 28, 2016

(65) Prior Publication Data

US 2017/0221305 A1 Aug. 3, 2017

(51) Int. Cl.
*G07F 17/32* (2006.01)

(52) U.S. Cl.
CPC ..... *G07F 17/3248* (2013.01); *G07F 17/323* (2013.01); *G07F 17/3262* (2013.01)

(58) Field of Classification Search
USPC ..... 463/25, 29, 31
See application file for complete search history.

(56) References Cited

U.S. PATENT DOCUMENTS

| | | | | |
|---|---|---|---|---|
| 7,081,033 | B1 | 7/2006 | Mawle | |
| 2004/0005921 | A1 | 1/2004 | Shinoda | |
| 2012/0238362 | A1* | 9/2012 | Janis | A63F 13/00 463/31 |
| 2016/0067599 | A1* | 3/2016 | Janis | A63F 13/00 463/22 |
| 2016/0067611 | A1* | 3/2016 | Ware | A63F 13/67 463/29 |
| 2016/0184634 | A1* | 6/2016 | Yanev | A63B 24/0062 482/8 |

* cited by examiner

*Primary Examiner* — Pierre E Elisca
(74) *Attorney, Agent, or Firm* — Sheppard Mullin Richter & Hampton LLP

(57) ABSTRACT

Users may participate in instances of a virtual space through computing platforms associated with the users. User participation may include controlling game entities within the instances of the virtual spaces. Individual game entities may be defined by attribute values of one or more game entity attributes. One or more attribute values may be modified from their currently defined values based on detection of physical tokens communicatively coupled to token readers. By way of non-limiting example, tokens may store attribute modification information that may specify discrete amounts by which one or more attribute values may be changed.

20 Claims, 3 Drawing Sheets

SYSTEM AND METHOD OF MODIFYING ATTRIBUTE VALUES OF GAME ENTITIES BASED ON PHYSICAL TOKEN DETECTION

FIELD OF THE DISCLOSURE

This disclosure relates to modifying attribute values of game entities based on physical token detection.

BACKGROUND

Physical token detection by a token reader may allow game entities to be presented within instances virtual space. Individual tokens may embody the physical appearance of individual game entities. Other tokens may embody other form factors. By way of non-limiting example, tokens may embody the physical appearance of virtual items and/or other objects. Detection of tokens may facilitate effectuating presentation of instances of virtual items within the virtual space.

SUMMARY

One aspect of the disclosure relates to a system configured for modifying attribute values of game entities based on physical token detection. Game entities may be defined by attribute values of one or more game entity attributes. The attribute values may be specified based on one or more of default attribute values for individual ones of the game entity attributes, gameplay within a virtual space, and/or other techniques. Modification to the one or more attribute values may be based on the attributes values defined for an individual game entity at the time of token detection, referred to as the "currently defined values." Individual token may store attribute modification information and/or other information that may facilitate making changes from the currently defined attribute values. For example, attribute modification information may specify discrete amounts by which one or more attribute values may be changed from their currently defined values.

In some implementations, the system may include one or more physical processors configured by machine-readable instructions. Executing the machine-readable instructions may cause the one or more physical processors to facilitate modifying attribute values of game entities based on physical token detection. The machine-readable instructions may include one or more of a user component, a space component, a token detection component, an attribute component, a modification component, and/or other components. In some implementations, one or more of the components may be included in machine-readable instructions of one or more physical processors included one or more servers. In some implementations, one or more of the components may be included in machine-readable instructions of one or more physical processors included one or more computing platforms associated with users.

The user component may be configured to access and/or manage one or more user identifications, user profiles, and/or user information associated with users of the system.

The space component may be configured execute an instance of a virtual space and implement the instance of the virtual space to facilitate participation by users in the virtual space via computing platforms associated with the users. User participation may include controlling game entities associated with the users within the virtual space. Individual game entities may be defined by attribute values of one or more game entity attributes. For example, game entity attributes may include one or more of appearance attributes, ability attributes, and/or other attributes. By way of non-limiting example, a first user may participate in a first instance of the virtual space via a first computing platform associated with the first user. Participation by the first user may include controlling a first game entity within the first instance of the virtual space. The first game entity may be currently defined at least in part by a first attribute value of a first appearance attribute, a second attribute value of a first ability attribute, and/or other attribute values of other game entity attributes.

The token detection component may be configured to detect tokens based on signals received from token readers. By way of non-limiting example, a first token reader may be communicatively coupled with the first computing platform. Individual token may be standalone physical objects. The tokens may include a first token, and/or other tokens. The first token may be detectable based on a first signal conveying information associated with the first token.

The attribute component may be configured to determine currently defined attribute values of one or more game entity attributes of one or more game entities associated with individual users. Currently defined attribute values may include attribute values at the time of token detection, and/or at other times. By way of non-limiting example, attribute component may be configured to determine at the time the first signal is received currently defined attribute values of the first game entity.

The modification component may be configured to obtain attribute modification information and/or other information based on signals received from token readers. The attribute modification information may facilitate making changes from currently defined attribute values of one or more game entities. By way of non-limiting example, first attribute modification information may be obtained based on a second signal received from the first token reader. The first attribute modification information may facilitate making changes from currently defined attribute values of the first game entity.

The modification component may be configured to effectuate modifications from currently defined attribute values of game entity attributes responsive to attribute modification information being obtained. The modifications may include a first modification and/or other modifications. By way of non-limiting example, the first modification may be made responsive to the first attribute modification information being obtained. The first modification may include one or more of a change from the first attribute value by a first amount, a change from the second attribute value by a second amount, and/or other changes.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
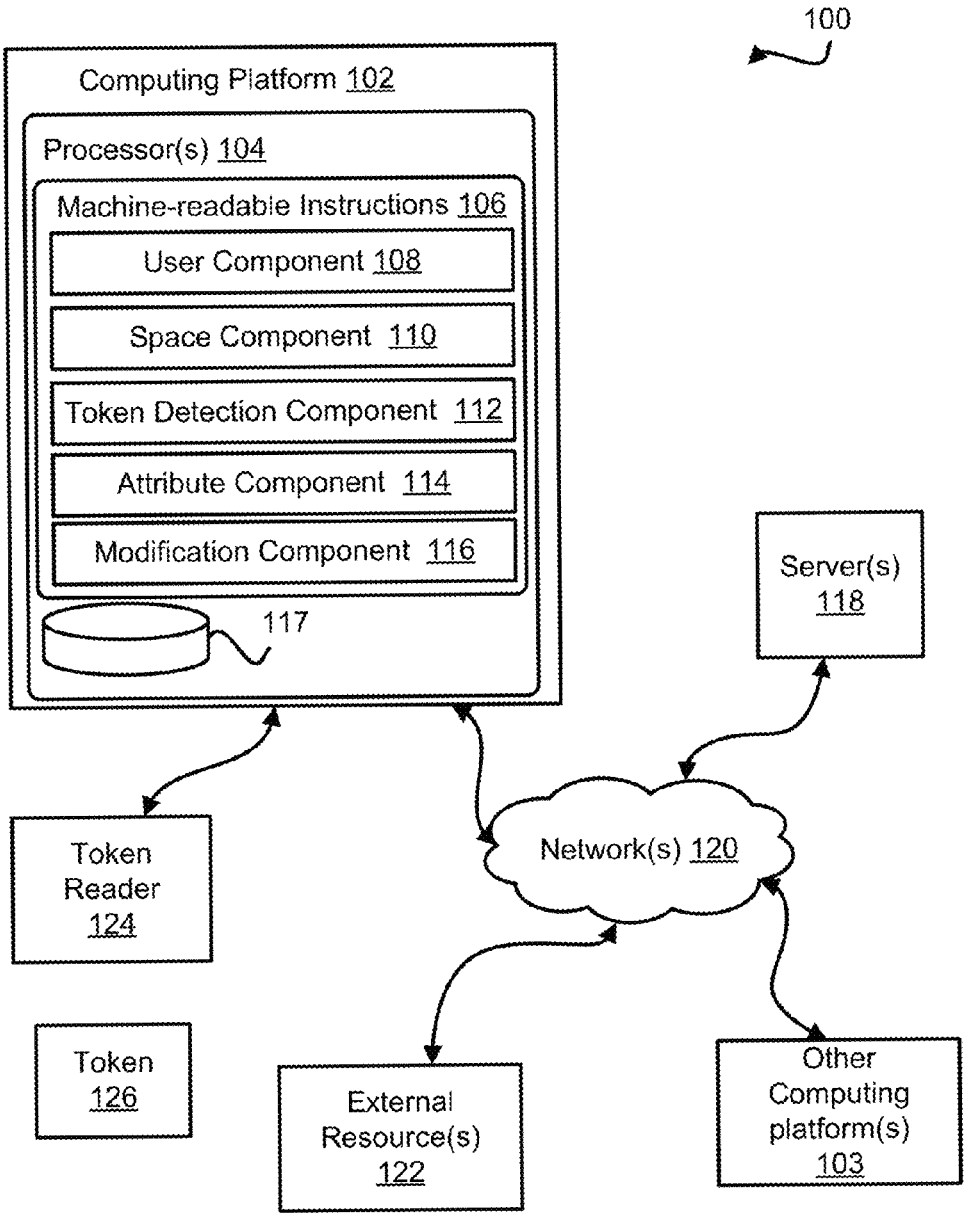
FIG. 1 illustrates a system configured for modifying attribute values of game entities based on physical token detection, in accordance with one or more implementations.

FIG. 1 illustrates a system 100 configured for modifying attribute values of game entities based on physical token detection, in accordance with one or more implementations. Game entities may be defined by attribute values of one or more game entity attributes. The attribute values may be specified based on one or more of default attribute values, gameplay within a virtual space, and/or other techniques. Modification to the one or more attribute values may be based on current attributes values defined for an individual game entity at the time of token detection. A given token may store attribute modification information and/or other information that may facilitate making changes from the currently defined attribute values. For example, attribute modification information may specify discrete amounts by which one or more attribute values may be changed from their currently defined values.

A given token may be a standalone physical object. In some implementations, the given token may be configured to depict a game entity, a virtual item, and/or other form factors. Examples of form factors may include one or more of a toy figurine, a toy accessory, a coin, and/or other form factors suitable to be tokens as described herein.

By way of non-limiting example, a token may be a toy figurine embodying an appearance of one or more of a game entity, virtual item, and/or other form factors. By way of non-limiting illustration, a given game entity may be Captain Jack Sparrow, the fictional character and protagonist of the Pirates of the Caribbean film series. A given virtual item may be an accessory associated with Captain Jack Sparrow, such as a sword. The given token may be a toy figurine embodying the appearance of Captain Jack Sparrow and/or the sword.

The system 100 may include one or more of one or more computing platforms (e.g., computing platform 102 and/or one or more other computing platforms 103), one or more servers 118, and/or other components. In some implementations, one or more computing platforms 102 and/or 103 may be configured to communicate with one or more servers (e.g., server(s) 118) according to a client/server architecture and/or other communication scheme. In some implementations, computing platform 102 may communicate with one or more other computing platforms 103 according to a peer-to-peer architecture, via communications routed through one or more servers 118, and/or other communication scheme. The users may access system 100 and/or the virtual space via computing platforms associated with the users (e.g., computing platform 102 and/or one or more other computing platforms 103). Individual computing platforms may include one or more of a cellular telephone, a smartphone, a laptop, a tablet computer, a desktop computer, a television set-top box, a client device, a smart TV, a gaming console, and/or other device suitable for the intended purposes as described herein.

The computing platform 102 may include one or more physical processors 104 configured by machine-readable instructions 106, and/or other components. Executing the machine-readable instructions 106 may cause computing platform 102 to facilitate modifying currently defined attribute values of game entities based on physical token detection. Computing platform 102 may be configured to execute an instance of the virtual space and/or a video game taking place in the virtual space by using information stored by and/or local to computing platform 102 (e.g., a game cartridge, game disk, memory card/stick, USB memory stick, electronic storage, and/or other considerations) and/or other information. The machine-readable instructions 106 may include one or more of a user component 108, a space component 110, a token detection component 112, an attribute component 114, a modification component 116, and/or other components. It is noted that descriptions of features and/or functions directed to computing platform 102 is for illustrative purposes only and not to be considered limiting. For example, in some implementations one or more features and/or functions attributed to computing platform 102 may be similarly applied to one or more other computing platforms 103 and/or server(s) 118.

It is further noted that in some implementations, providing the virtual space may include hosting the virtual space via one or more servers 118 over network 120. By way of non-limiting example, one or more servers 118 may include machine-readable instructions that may include one or more of the same or similar components of machine-readable instructions 106 of computing platform 102. In some implementations, hosting the virtual space via server(s) 118 may comprise an "online" version of the virtual space, while hosting the virtual space by executing one or more components of machine-readable instructions 106 may comprise an "offline" version of the virtual space.

The user component 108 may be configured to access and/or manage one or more user identifications, user profiles, and/or user information associated with users of system 100. The one or more one or more user identifications, user profiles, and/or user information may include information stored by computing platform(s) 102, server(s) 118, and/or other storage locations. The one or more user identifications, user profiles, and/or user information may include, for example, information identifying users (e.g., a username or handle, a number, an identifier, and/or other identifying information) within the virtual space, security login information (e.g., a login code or password), virtual space account information, subscription information, virtual currency account information (e.g., related to currency held in credit for a user), relationship information (e.g., information related to relationships between users in the virtual space), virtual space usage information, demographic information associated with users, interaction history among users in the virtual space, information stated by users, purchase information of users, browsing history of users, a computing platform identification associated with a user, a phone number associated with a user, gameplay information (e.g., attribute values of game entity attribute of one or more game entities associated with the user, and/or other information), virtual item inventory information (e.g., related to one or more virtual items available for use within the virtual space), and/or other information related to users.

The space component 110 may be configured to implement one or more instances of the virtual space and/or video game taking place in the virtual space executed by machine-readable instructions 106 to determine views of the virtual space. In some implementations where the virtual space may be hosted by server(s) 118, the views may then be communicated (e.g., via streaming, via object/position data, and/or other information) from server(s) 118 to computing platform (s) 102 for presentation to users. The view determined and presented to a given user may correspond to a game entity being controlled by the given user. The view determined and presented to the given user may correspond to a location in the virtual space (e.g., the location from which the view is taken, the location the view depicts, and/or other locations), a zoom ratio, a dimensionality of objects, a point-of-view, and/or view parameters. One or more of the view parameters may be selectable by the user.

The instance of the virtual space may comprise a simulated space that is accessible by users via computing platform 102 that present the views of the virtual space. The simulated space may have a topography, express ongoing real-time interaction by one or more users, and/or include one or more objects positioned within the topography that are capable of locomotion within the topography. In some instances, the topography may be a 2-dimensional topography. In other instances, the topography may be a 3-dimensional topography. The topography may include dimensions of the space, and/or surface features of a surface or objects that are "native" to the space. In some instances, the topography may describe a surface (e.g., a ground surface) that runs through at least a substantial portion of the space. In some instances, the topography may describe a volume with one or more bodies positioned therein (e.g., a simulation of gravity-deprived space with one or more celestial bodies positioned therein). The instance executed by machine-readable instructions 106 may be synchronous, asynchronous, and/or semi-synchronous.

The above description of the manner in which views of the virtual space are determined by space component 110 is not intended to be limiting. The space component 110 may be configured to express the virtual space in a more limited, or richer, manner. For example, views determined for the virtual space may be selected from a limited set of graphics depicting an event in a given place within the virtual space. The views may include additional content (e.g., text, audio, pre-stored video content, and/or other content) that describes particulars of the current state of the place, beyond the relatively generic graphics. For example, a view may include a generic battle graphic with a textual description of the opponents to be confronted. Other expressions of individual places within the virtual space are contemplated.

Within the instance(s) of the virtual space executed by space component 110, users may control game entities, objects, simulated physical phenomena (e.g., wind, rain, earthquakes, and/or other phenomena), and/or other elements within the virtual space to interact with the virtual space and/or each other. One or more user controlled element(s) may move through and interact with the virtual space (e.g., non-user characters in the virtual space, other objects in the virtual space). The user controlled elements controlled by and/or associated with a given user may be created and/or customized by the given user. The user may have an "inventory" of virtual items and/or currency that the user can use (e.g., by manipulation of a game entity or other user controlled element, and/or other items) within the virtual space.

Virtual items may include one or more of a virtual weapon, a tool, a food, a currency, a reward, a bonus, health, a potion, an enhancement, a mount, a power-up, a speed-up, clothing, a vehicle, an anatomical feature of a game entity, a troop or troop type, a pet, a virtual resource, and/or other virtual items and/or goods.

User participation in the virtual space may include controlling one or more of the available user controlled elements in the virtual space. Control may be exercised through control inputs and/or commands input by the users through computing platform(s) 102. The users may interact with each other through communications exchanged within the virtual space. Such communications may include one or more of textual chat, instant messages, private messages, voice communications, and/or other communications. Communications may be received and entered by the users via their respective computing platform(s) 102. Communications may be routed to and from the appropriate users through server(s) 118.

User participation in the virtual space may include controlling game entities in the virtual space. A game entity may refer to a virtual object (or group of objects) present in the virtual space that represents an individual user. A game entity may be a virtual character (e.g., an avatar) and/or other virtual object. A group of game entities may include a group of virtual characters, virtual objects, and/or other groups.

In some implementations, an instance of the virtual space may be persistent. That is, the virtual space may continue on whether or not individual players are currently logged in and/or participating in the virtual space. A user that logs out of the virtual space and then logs back in some time later may find the virtual space has been changed through the interactions of other players with the virtual space during the time the player was logged out. These changes may include changes to the simulated physical space, changes in the user's inventory, changes in other user's inventories, changes experienced by non-player characters, changes to the virtual items available for use in the virtual space, and/or other changes.

In some implementations, individual game entities may be defined by attribute values of one or more game entity attributes, and/or other information. In some implementations, attribute values of one or more game entity attributes may comprise one or both of default attribute values, values defined based on gameplay, and/or other attribute values.

In some implementations, default attribute values may correspond to a set of attribute values associated with an initial instantiation of a game entity within an instance of the virtual space. Initial instantiation may refer to a first use of a game entity by a user within an instance of the virtual space absent prior gameplay using the game entity. In some implementations, one or more game entities of an individual game entity type may be associated with a same or similar set of default attribute values. By way of non-limiting example, different instances of an individual game entity may be associated with different users. The different instances may be associated with the same set of default attribute values.

In some implementations, attribute values of one or more game entity attributes may be set and/or otherwise defined based on user gameplay in the virtual space. For example, a user may interact with the virtual space through gameplay in a manner which may modify individual attribute values of one or more game entity attributes. A user's progress in the game may allow them to "up-grade" one or more attribute values of one or more game entities they control in the virtual space. By way of non-limiting example, a user may progress through gameplay in the virtual space such that their game entity may become faster, stronger, stealthier, heal faster, and/or may be up-graded in other ways. This may be referred to as "leveling up" a game entity. By way of non-limiting illustration, a user's progress in the virtual space using a first game entity may cause a first attribute value of a first game entity attribute to change to a second attribute value and/or other values.

In some implementations, a game entity attribute may include one or more of an appearance attribute, an ability attribute, a behavior attribute, an inventory attribute, and/or other attributes.

An appearance attribute may include one or more of a color attribute, a surface texture attribute, a special visual effect attribute, virtual clothing attribute, anatomic feature attribute, and/or other attributes.

Values of a color attribute may specify a color of one or more surfaces of a game entity within the virtual space. Surfaces may include one or more of simulated skin, hair, appendages, and/or other surface. By way of non-limiting example, an attribute value of a color attribute may specify one or more of red, blue, green, black, brown, tan, beige, and/or other colors. An attribute value of a color attribute may further specify transparency values of one or more colors, and/or other information.

Values of a surface texture attribute may specify surface texture features of one or more surfaces of a game entity within a virtual space. By way of non-limiting example, an attribute value of a surface texture attribute may specify one or more of smooth, rough, hairy, scaly, shiny, transparent, cloth-like, metallic, and/or other surface texture features.

Values of a special visual effect attribute may specify one or more visual effects associated with a game entity within the virtual space. By way of non-limiting example, an attribute value of a special visual effect attribute may specify one or more of a glow, an aura, trails of light, presence or absence of shadows, footprints or lack thereof, oily, watery, gooey drips, cycling skin mutations, cycling transparency, and/or other visual effects.

Values of a virtual clothing attribute may specify one or more articles of virtual clothing a game entity may be depicted as wearing within the virtual space. By way of non-limiting example, an attribute value of a virtual clothing attribute may specify one or more of a hat, a shirt, a cape, shoes, pants, and/or other clothing a game entity may be depicted as wearing. In some implementations, attribute values of a virtual clothing attribute may specify appearance features of individual articles of virtual clothing. Appearance features may include one or more of color, design, shape, form, and/or other appearance features of individual articles of virtual clothing.

Values of an anatomic feature attribute may specify one or more features that make up the anatomy of a game entity. By way of non-limiting example, an attribute value of an anatomic feature attribute may specify one or more of a quantity of appendages, a size of the game entity, a size of individual appendages, and/or other anatomical features. By way of non-limiting illustration, an attribute value of a anatomic feature attribute may specify one or more of that a game entity may include additional appendages (temporarily or permanently), may increase (or decrease) in size, and/or other anatomic feature specifications.

Attribute values of an ability attribute may specify one or more abilities of a game entity within the virtual space. In some implementations, abilities may correspond to one or more actions performable by a game entity within the virtual space. An action may include one or more of walking, running, jumping, healing, fighting (e.g., punching, kicking, dodging, using special weapons, and/or other fighting actions), driving vehicles, riding, carrying heavy objects, climbing, flying, changing size or visibility, controlling the actions of other game entities, and/or other actions. In some implementations, an attribute value of an ability attribute may specify some measure of a game entity's ability to perform an action within the virtual space. By way of non-limiting example, an attribute value of an ability attribute may specify one or more of a power level of a particular action a game entity may be capable of performing in the virtual space.

Attribute values may be expressed one or more of numerically (e.g., level 1, level 2, and/or other numerical description), descriptively (e.g., strong, moderate, weak, red, green, ledge climb, special gun 1, and/or other descriptive representation and/or other descriptive representation), using reference to other game assets (e.g., AttributeList1, MickeyCostume, and/or other assets), and/or expressed in other ways.

By way of non-limiting example, an attribute value may specify one or more of a strength, power, speed, agility, and/or other measure of a game entity's ability to perform an action within the virtual space. By way of non-limiting example, a first attribute value of an ability attribute may specify that a game entity punches with "level 1" power, while a second attribute value of an ability attribute may specify that a game entity punches with a "level 4" power. By way of non-limiting example, a third attribute value of an ability attribute may specify that a game entity runs with "slow", while a fourth attribute value of an ability attribute may specify that a game entity runs "fast."

Attribute values of a behavior attribute may specify the way in which a game entity behaves within the virtual space. In some implementations, behavior may correspond to how a game entity visually performs actions within the virtual space. An action may include one or more of walking, running, jumping, fighting, healing, driving, carrying, flying, climbing, repairing, and/or other actions. By way of non-limiting example, a first attribute value of a behavior attribute may specify that a game entity walks with a short stride. By way of non-limiting example, a second attribute value of a behavior attribute may specify that a game entity walks with a long stride. Attribute values of a behavior attribute may be considered in other ways.

Attribute values of an inventory attribute may specify one or more virtual items that a game entity may use with the virtual space, one or more virtual items a game entity may be equipped with within the virtual space, and/or one or more virtual items that may otherwise be made available to the game entity within a virtual item inventory associated with the game entity. By way of non-limiting example, a first attribute value of an inventory attribute may specify that a game entity is equipped with a first virtual item within the virtual space, while a second attribute value of an inventory attribute may specify that a game entity is equipped with a second virtual item with the virtual space. The first virtual item may be a first weapon used for combat, such as a sword, while the second virtual item may be a second weapon used for combat, such as a gun. In some implementations, a third virtual item may be an article of clothing (e.g., a cloak) that grants the game entity the ability to be invisible.

It is noted that the above description of attribute values and/or game entity attribute are provided for illustrative purpose and is not intended to be considered limiting. For example in some implementations, game entity attributes may include one or more other attributes not listed and/or attribute values may be expressed in other ways.

In some implementations, space component 110 may be configured to effectuate presentation of a game entity within an instance of the virtual space responsive to a token associated with the game entity being detected by a token reader 124 (see, e.g., token detection component 112). By way of non-limiting example, detection of a token embodying a physical appearance of a game entity by a token reader (e.g., token reader 124) coupled to a computing platform (e.g., an individual one of computing platform(s) 102) may facilitate effectuating presentation of the game entity within an instance of the virtual space. The game entity may be made available for control by the user within the virtual space. In some implementations, the game entity may be presented within the instance of the virtual space for so long as the token continues to be detected by the token reader. For example, once the token is removed from the token reader and/or otherwise made undetectable by the token reader, the game entity may be "removed" from the virtual space and/or otherwise may no longer be available to the user within the instance of the virtual space. However, in some implementations, continued detection of the token by a token reader may not be required for the game entity to remain available within the instance of the virtual space. For example, the token may have to be detected at least once in order for the corresponding game entity to be made available within the instance of the virtual space.

The token detection component 112 may be configured to detect tokens based on signals received from a token reader 124. A given token (e.g., token 126) may be a standalone physical object. Individual tokens may be configured to be detectable by token reader 124. In some implementations, detection of a given token may be based on a shape of a portion of the given token, and/or other detection techniques. In some implementations, a given token may be detectable based on a given signal emitted from the given token conveying information associated with the given token, and/or other detection techniques.

In some implementations, detection of a given token may be facilitated by electronics embedded within or otherwise included in the given token. For example, the given token may include a radio-frequency identification (RFID) chip configured to emit and/or receive radio-frequency electromagnetic fields responsive to the given token being disposed in a proximity of token reader 124, and/or other components. As another example, the given token may include an integrated circuit configured to transfer information associated with the given token responsive to the given token being placed in contact with a portion of token reader 124. A given token may include electronic storage configured to store information associated with the given token.

The token reader 124 may be configured to provide signals associated with individual tokens. A given signal may convey information associated with the given token (information stored by the given token), and/or other information. In some implementations, token reader 124 may be configured to provide a first signal responsive to one or more of a first token abutting a portion of the token reader, the first token being disposed in a proximity of the token reader, and/or other actions configured to facilitate detection of the first token. According to some implementations, token reader 124 may be a peripheral device configured to be communicatively coupled with one or more components of system 100. In some implementations, token reader 124 may be integrated so as to form a singular device with a component of system 100 (e.g., a given virtual space platform 102). According to some implementations, one or more of the computing platform(s) 102 may be communicatively coupled with token reader 124, while one or more of the computing platform(s) 102 may not be communicatively coupled with and/or otherwise associated with a token reader. For example, a stationary computing platform may have an integrated token reader, while a mobile computing platform may not have a token reader associated therewith.

In some implementations, token reader 124 may be configured to communicate information to individual tokens via signals conveying the information (e.g., write information back to a given token). By way of non-limiting example, token reader 124 may be configured to obtain information from one or more of one or more computing platforms 102/103, server(s) 118, and/or from other information sources. Information obtained by token reader 124 may comprise gameplay information, and/or other information. Gameplay information may comprise information associated with gameplay in the virtual space. By way of non-limiting example, gameplay information may comprise attribute values of one or more game entity attributes determined at the end of a prior session within the virtual space. The gameplay information may be compiled into a signal that the token reader 124 may communicate back to a given token (e.g., a token embodying the physical appearance of a game entity with which the attribute values may be associated).

By way of non-limiting illustration, token 126 may be configured to store information associated with token 126, and/or other information. Token 126 may include electronic storage (not shown in FIG. 1) configured to store information, and/or other components. In some implementations, information stored by token 126 may include one or more of identifying information that may identify the token 126 (e.g., a name, a serial number, an identifier, and/or other identifying information), gameplay information (e.g., attribute values of one or more game entity attributes that were defined at the end of prior gameplay within the virtual space, and/or other information), attribute modification information, attribute modification information look-up information, and/or information.

In some implementations, attribute modification information may facilitate making changes from currently defined attribute values of the game entities, and/or other changes. By way of non-limiting example, attribute modification information may facilitate making changes from currently defined attributes values by one or more discrete amounts. In some implementations, attribute modification information may facilitate defining new attribute values independent from the currently defined attribute values.

In some implementations, attribute modification information may specify discrete amounts by which one or more currently defined attribute values of one or more game entity attributes may be changed. A discrete amount may be specified as one or more of an increase in a currently defined attribute value, a decrease in a currently defined value, a multiple of a currently defined attribute value, and/or other changes from one or more currently set attribute values.

By way of non-limiting example, a change may specify changing a currently defined attribute value of a first attribute of a game entity by a first amount. The currently defined attribute value may comprise a first attribute value. The change may cause the first attribute value to change by the first amount to a first modified attribute value. By way of non-limiting illustration, the first attribute may be an ability attribute associated with "punching" and/or other ability. The first amount may comprise, for example, "2 levels." The change may therefore specify that a game entity's punching power should increase from the first attribute value by "2 levels," and/or other amounts. If the first attribute values specifies "level 1" punching power, the first modified attribute value may specify "level 3" punching power.

By way of non-limiting illustration, a change may specify changing a currently defined attribute value of a second attribute of a game entity by a second amount. The second attribute may be an appearance attribute associated with a color of the game entity, and/or other appearance attribute. The second amount may comprise, for example, "5 shades brighter," and/or other amount. The change may therefore specify that a game entity's color appearance should increase from a currently set color value by "5 shades brighter," and/or other amounts.

In some implementations, a change may specify a new attribute value for a third attribute of a game entity independent from a currently defined attribute value. The third attribute may be an appearance attribute associated with an article of virtual clothing worn by the game entity, and/or other appearance attribute. The new attribute value may comprise, for example, "a pirate's hat," and/or other article of virtual clothing. The change may therefore specify that a game entity's appearance should now include a pirates hat being worn by the game entity in the virtual space (independent from what headwear the game entity may or may not have been wearing).

Attribute modification information look-up information may facilitate determining attribute modification information based on a look-up of the information within one or more storage locations that are different from an individual token. By way of non-limiting example, one or more of computing platform 102, one or more other computing platforms 103, server(s) 118, and/or other entities participating in system 100 may store attribute modification information. The attribute modification information look-up information may comprise one or more of a name, a serial number, an identifier, a network address, file location within an archive or on storage, and/or other look-up information that may facilitate determining attribute modification information from one or more storage locations. In some implementations, storing attribute modification information look-up information (as opposed to attribute modification information itself) may reduce the amount of information needed to be stored at a given token.

In some implementations, attribute modification information may include changes to attribute values of multiple ones of the game entity attributes. In some implementations, changes to attribute values of different ones of the game entity attributes may be related by a common theme. By way of non-limiting example, a theme may be associated with a game entity, a movie, a real-world location, a virtual location, a person, a group of people, a time period (e.g., "the 1920's," and/or other time period, and/or other themes.

By way of non-limiting example, a change specifying a new attribute value of an appearance attribute, a change from a currently defined value of an ability attribute, and/or other changes included in attribute modification information may be related by a common theme. The theme may be associated with an individual game entity and/or other themes. For illustration, the theme may be the fictitious character HULK, and/or other theme. The character is generally known for its green color and incredible strength. The new attribute value of the appearance attribute may be associated with making the game entity appear "green." The change from the currently set value of the ability attribute may be associated with increasing the game entity's punching power by some amount (e.g., 5 levels and/or other amount). Other changes specified in attribute modification information may be made in accordance with the theme (e.g., the game entity's size may be increased, and/or other changes).

The attribute component 114 may be configured to determine currently defined attribute values of one or more game entity attributes of one or more game entities associated with individual users. The attribute values may be determined as "current" with respect to when token detection may take place, attribute modification information may be obtained, and/or at other times. As presented herein, currently defined attribute values may include one or both of default attribute values and/or values defined based on gameplay.

In some implementations, attribute component 114 may be configured to determine currently defined attribute values by querying one or more of user component 108, space component 110, and/or other components of system 100. By way of non-limiting example, at a prior gameplay session in the virtual space, a user may have "up-graded" and/or other modified one or more attribute values of a given game entity, and/or may have one or more attribute values still defined by default values. The attribute values may have be stored within gameplay information associated with the user and/or game entity (e.g., within user component 108, electronic storage of a given token, and/or other component).

By way of non-limiting example, token reader 124 may be configured to provide signals conveying information associated with a token 126. The information associated with token 126 may include one or more of information that facilitates detection and/or identification of token 126, first attribute modification information, and/or other information. By way of non-limiting example, detection and/or identification of token 126 may be facilitated based on a first signal received from the token reader 124 that conveys information associated with token 126 and/or other information. A detection and/or identification of token 126 may facilitate effectuating a first game entity associated with token 126 within an instance of the virtual space. The first game entity may be instantiated based on gameplay information associated with the first game entity. For example, gameplay information may include currently defined attribute values of the game entity. Currently defined values may include one or both of default attribute values and/or values defined from prior gameplay within the virtual space by a user using the first game entity. Such values may be determined from one or more of the user component 108, space component 110, other components, token 126, and/or other locations. The attribute component 114 may be configured to determine one or more of the currently defined attribute values.

The modification component 116 may be configured to obtain attribute modification information based on signals received from token readers. As presented herein, one or more signals received from a token reader (e.g., token reader 124) may convey one or more of attribute modification information, attribute modification information look-up information, and/or other information. In some implementations, modification component 116 may be configured to obtain attribute modification information based on determining the attribute modification information from signals received from token readers. In some implementations, modification component 116 may be configured to obtain attribute modification information based on one or more of determining attribute modification information look-up information from signals received from token readers, retrieving the attribute modification information from a storage location using the attribute modification information look-up information, and/or other operations.

By way of non-limiting example, modification component 116 may be configured to obtain first attribute modification information on a second signal received from token reader 124. The first attribute modification information may facilitate making changes from currently attribute values of the first game entity. For the example, the first attribute modification information may be associated with a first modification and/or other modifications. The first modification may include a change from currently defined attribute values of game entity attributes of the first game entity. In some implementations, the second signal may be received from token reader 124 responsive to a token that is different from a token embodying the physical appearance of the first game entity being detectable by token reader 124. In some implementations, the information conveyed by the first signal and the second signal may instead be conveyed by a single signal received from token reader 124.

The modification component 116 may be configured to effectuate modifications from currently defined attribute values of game entity attributes responsive to attribute modification information being obtained. In some implementations, modifications may be effectuated in real time as attribute modification information is obtained. In some implementations, modifications may only be effectuated while one or both of a token embodying the physical appearance of a game entity (e.g., and facilitating presentation of the game entity within in instance of the virtual space), and another token configured to store attribute modification information (and/or attribute modification information look-up information) being concurrently detected by token reader 124. In some implementations, concurrent detection of the tokens may not be required to effectuated modifications.

By way of non-limiting illustration, modification component 116 may be configured to effectuate the first modification and/or other modifications. The first modification may include a change from the first attribute value by the first amount, and the second attribute value by the second amount, and/or other changes.

Figure 2:
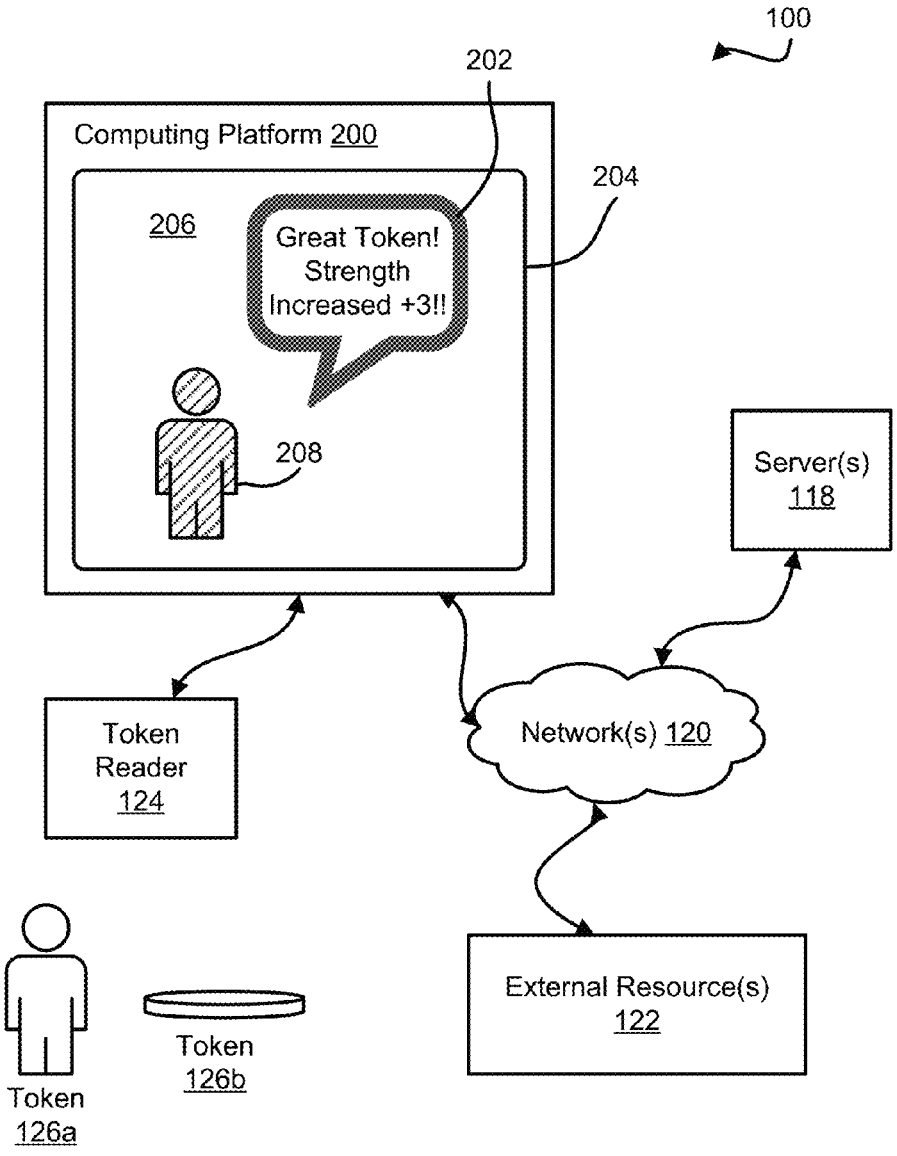
FIG. 2 illustrates an exemplary implementation of the system of FIG. 1.

By way of non-limiting illustration, FIG. 2 illustrates an exemplary implementation of system 100 of FIG. 1. System 100 in FIG. 2 include one or more of computing platform 200 (e.g., one of computing platforms 102 and/or 103), one or more servers 118, token reader 124, a first token 126*a*, a second token 126*b*, external resources 122, and/or other components. Computing platform 200 may include a display screen 204 configured to present a view 206 of an instance of a virtual space. The instance of the virtual space may include an instance of a first game entity 208. In some implementations, the first game entity 208 may be instantiated within the instance of the virtual space responsive to a first token 126*a* being detected by token reader 124. By way of non-limiting example, first token 126*a* may comprise a toy figurine embodying the physical appearance of first game entity 208.

In some implementations, first attribute modification information may be obtained based on signals received from token reader 124. For example, the signals may convey information stored by second token 126*b* which may be conveyed to token reader 124 responsive to second token 126*b* being detected by token reader 124. In some implementations, one or more modifications from one or more currently defined attribute values of the first game entity 208 may be effectuated responsive to the first attribute modification information being obtained. For example, the one or more modifications may include a first modification. The first modification may comprise a change from a first attribute value of a first game entity attribute by a first amount, a change from a second attribute value of a second game entity attribute by a second amount, and/or other changes. For illustrative purposes, the first game entity attribute may comprise an appearance attribute related to color. The first amount may comprise an increase by "3 shades brighter," The second game entity attributer may comprise an ability attribute related to strength. The second amount may comprise an increase in 3 levels. The changes may be visually shown by a text prompt 202 displayed in the view 206 of the instance of the virtual space, a change in color of the first game entity 208, and/or represented in other ways.

Returning to FIG. 1, the computing platform 102, one or more other computing platforms 103, server(s) 118, and/or external resources 122 may be operatively linked via one or more electronic communication links. For example, such electronic communication links may be established, at least in part, via a network 120 such as the Internet and/or other networks. It will be appreciated that this is not intended to be limiting and that the scope of this disclosure includes implementations in which computing platform(s) 102/103, server(s) 118, and/or external resources 122 may be operatively linked via some other communication media.

The external resources 122 may include sources of information, hosts, and/or providers of virtual spaces outside of system 100, external entities participating with system 100, external entities for player-to-player communications, and/or other resources. In some implementations, some or all of the functionality attributed herein to external resources 122 may be provided by resources included in system 100.

The computing platform 102 may include electronic storage 117, one or more processors 104, and/or other components. The computing platform 102 may include communication lines or ports to enable the exchange of information with network 120, server(s) 118, external resources 122, and/or one or more other computing platforms 103. Illustration of computing platform 102 in FIG. 1 is not intended to be limiting. The computing platform 102 may include a plurality of hardware, software, and/or firmware components operating together to provide the functionality attributed herein to computing platform 102. For example, computing platform 102 may be implemented by a cloud of computing platforms operating together as computing platform 102. Further, illustration of server(s) 118 in FIG. 1 is not intended to be limiting. Server(s) 118 may be implemented by a cloud of computing platforms operating together as server(s) 118.

Electronic storage 117 may comprise electronic storage media that electronically stores information. The electronic storage media of electronic storage 117 may include one or both of system storage that is provided integrally (i.e., substantially non-removable) with computing platform 102 and/or removable storage that is removably connectable to computing platform 102 via, for example, a port or a drive. A port may include a USB port, a firewire port, and/or other port. A drive may include a disk drive and/or other drive. Electronic storage 117 may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. The electronic storage 117 may include one or more virtual storage resources (e.g., cloud storage, a virtual private network, and/or other virtual storage resources). Electronic storage 117 may store software algorithms, information determined by processor 104, information received from server(s) 118, information received from other computing platforms 102, and/or other information that enables computing platform(s) 102 to function as described herein.

Processor(s) 104 is configured to provide information-processing capabilities in computing platform 102. As such, processor(s) 104 may include one or more of a physical processor, a digital processor, an analog processor, a digital circuit designed to process information, an analog circuit designed to process information, a state machine, and/or other mechanisms for electronically processing information. Although processor(s) 104 is shown in FIG. 1 as a single entity, this is for illustrative purposes only. In some implementations, processor(s) 104 may include one or more processing units. These processing units may be physically located within the same device, or processor(s) 104 may represent processing functionality of a plurality of devices operating in coordination. Processor(s) 104 may be configured to execute components 108, 110, 112, 114, and/or 116. Processor(s) 104 may be configured to execute components 108, 110, 112, 114, and/or 116 by software; hardware; firmware; some combination of software, hardware, and/or firmware; and/or other mechanisms for configuring processing capabilities on processor(s) 104.

It should be appreciated that although components 108, 110, 112, 114, and/or 116 are illustrated in FIG. 1 as being co-located within a single processing unit, in implementations in which processor(s) 104 includes multiple processing units, one or more of components 108, 110, 112, 114, and/or 116 may be located remotely from the other components. The description of the functionality provided by the different components 108, 110, 112, 114, and/or 116 described above is for illustrative purposes and is not intended to be limiting, as any of components 108, 110, 112, 114, and/or 116 may provide more or less functionality than is described. For example, one or more of components 108, 110, 112, 114, and/or 116 may be eliminated, and some or all of its functionality may be provided by other ones of components 108, 110, 112, 114, 116, and/or other components. As another example, processor(s) 104 may be configured to execute one or more additional components that may perform some or all of the functionality attributed below to one of components 108, 110, 112, 114, and/or 116.

Figure 3:
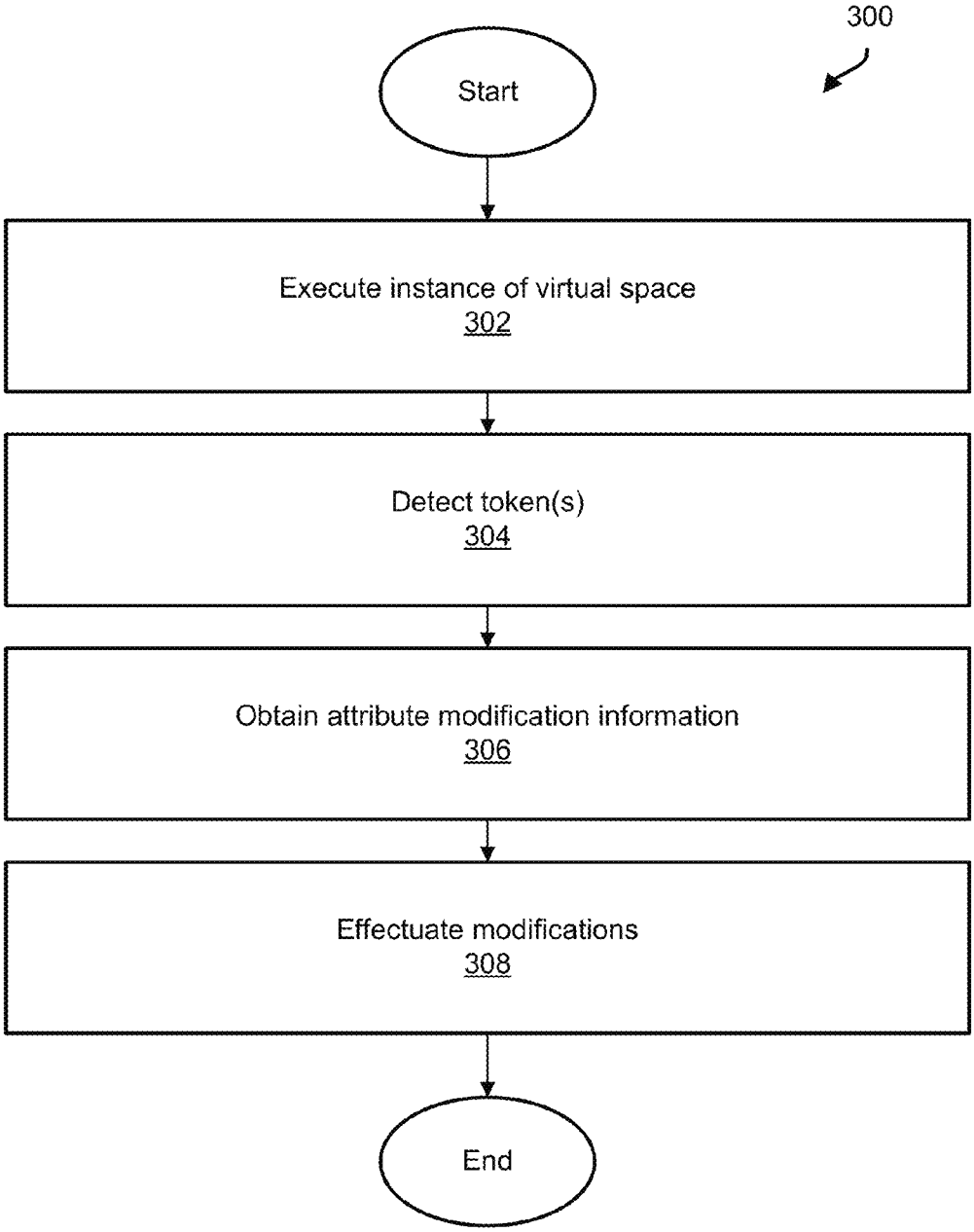
FIG. 3 illustrates a method of modifying attribute values of game entities based on physical token detection, in accordance with one or more implementations.

FIG. 3 illustrates a method 300 of modifying attribute values of game entities based on physical token detection. The operations of method 300 presented below are intended to be illustrative. In some embodiments, method 300 may be accomplished with one or more additional operations not described, and/or without one or more of the operations discussed. Additionally, the order in which the operations of method 300 are illustrated in FIG. 3 and described below is not intended to be limiting.

In some implementations, method 300 may be implemented in a computer system comprising one or more of one or more processing devices (e.g., a physical processor, a digital processor, an analog processor, a digital circuit designed to process information, an analog circuit designed to process information, a state machine, and/or other mechanisms for electronically processing information), storage media storing machine-readable instructions, and/or other components. The one or more processing devices may include one or more devices executing some or all of the operations of method 300 in response to instructions stored electronically on electronic storage media. The one or more processing devices may include one or more devices configured through hardware, firmware, and/or software to be specifically designed for execution of one or more of the operations of method 300.

At an operation 302, one or more instances of a virtual space may be executed. The one or more instances of the virtual space may be implemented to facilitate participation by users in the virtual space via computing platforms associated with the users. User participation may include controlling game entities associated with the users within the virtual space, and/or other methods of participation. Individual game entities may be defined by attribute values of game entity attributes. Game entity attributes may include one or more of appearance attributes, ability attributes, and/or other attributes. By way of non-limiting example, a first user may participate in a first instance of the virtual space via a first computing platform associated with the first user. Participation by the first user may include controlling a first game entity within the first instance of the virtual space. The first game entity may be currently defined, at least in part, by a first attribute value of a first appearance attribute, a second attribute value of a first ability attribute, and/or other attribute values of one or more other game entity attributes. In some implementations, operation 302 may be performed by one or more physical processors executing a space component the same as or similar to space component 110 (shown in FIG. 1 and described herein).

At an operation 304, one or more tokens may be detected. Individual tokens may be standalone physical objects. The tokens may include a first token, and/or other tokens. Individual tokens may be detected based on signals received from token readers. By way of non-limiting example, the first token reader may be communicatively coupled with the first computing platform. The first token may be detectable based on a first signal and/or other signals conveying information associated with the first token. In some implementations, operation 304 may be performed by one or more physical processors executing a token detection component the same as or similar to token detection component 112 (shown in FIG. 1 and described herein).

At an operation 306, attribute modification information may be obtained based on signals received from token readers. The attribute modification information may facilitate making changes from currently defined attribute values of one or more game entities. By way of non-limiting example, first attribute modification information may be obtained based on a second signal received from the first token reader. The first attribute modification information may facilitate making changes from currently defined attribute values of the first game entity. In some implementations, operation 306 may be performed by one or more physical processors executing a modification component the same as or similar to the modification component 116 (shown in FIG. 1 and described herein).

At an operation 308, modifications from currently defined attribute values of one or more game entities may be effectuated responsive to attribute modification information being obtained. By way of non-limiting example, the modifications may include a first modification configured to be effectuated responsive to the first attribute modification information being obtained. The first modification may include a change from one or more of the first attribute value by a first amount, the second attribute value by a second amount, and/or other changes. In some implementations, operation 306 may be performed by one or more physical processors executing a modification component the same as or similar to the modification component 116 (shown in FIG. 1 and described herein).

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A system for modifying attribute values of game entities based on physical token detection, the system comprising:

one or more physical processor configured by non-transitory machine-readable instructions to:

execute instances of a virtual space and implement the instances of the virtual space to facilitate participation by users in the virtual space via computing platforms associated with the users, user participation including controlling game entities associated with the users within the virtual space, individual game entities defined by attribute values of appearance attributes and ability attributes, such that a first user participates in a first instance of the virtual space via a first computing platform associated with the first user, participation by the first user including controlling a first game entity within the first instance of the virtual space, wherein the first game entity is currently defined at least in part by a first attribute value of a first appearance attribute and a second attribute value of a first ability attribute;

detect tokens based on signals received from token readers, a first token reader being communicatively coupled with the first computing platform, individual tokens being standalone physical objects, the tokens including a first token, the first token being detectable based on a first signal conveying information associated with the first token;

obtain attribute modification information based on signals received from token readers, the attribute modification information facilitating making changes from currently defined attribute values of the game entities, such that first attribute modification information is obtained based on a second signal, the first attribute modification information facilitating making changes from currently defined attribute values of the first game entity; and effectuate modifications from currently defined attribute values of game entity attributes responsive to attribute modification information being obtained, the modifications including a first modification configured to be effectuated responsive to the first attribute modification information being obtained, the first modification including a change from the first attribute value by a first amount, and from the second attribute value by a second amount.

2. The system of claim 1, wherein currently defined attribute values comprise one or both of default attribute values or attribute values defined based on gameplay within the virtual space.

3. The system of claim 2, wherein individual groups of game entities are associated with an individual game entity type, wherein game entities of an individual game entity type are associated with a set of default attribute values, such that the first game entity and a second game entity are of a first game entity type, and wherein the first game entity and second game entity are associated with the same set of default attribute values.

4. The system of claim 1, wherein attribute modification information is stored by the tokens and conveyed by signals received from the token readers, such that the second signal conveys the first attribute modification information.

5. The system of claim 1, wherein attribute modification information is stored in a location other the tokens, such that the first attribute modification information is obtained from a storage location that is not associated with the first token.

6. The system of claim 5, wherein the second signal conveys information used to look-up the first attribute modification information from the storage location.

7. The system of claim 1, wherein the modifications are effectuated in real-time responsive to attribute modification information being obtained.

8. The system of claim 1, wherein attribute values of appearance attributes define one or more of color, surface texture, special visual effects, or virtual clothing associated with individual game entities.

9. The system of claim 1, wherein attribute values of ability attributes define one or more abilities of individual game entities within the virtual space.

10. The system of claim 9, wherein the second attribute value of the first ability attribute of the first game entity specifies a first level of a first ability of the first game entity, and wherein the first attribute modification information specifies an increase in the level of the first ability by the second amount, such that the second attribute value is changed to a first modified attribute value that specifies a second level of the first ability that is greater than the first level by the first amount.

11. A method of modifying attribute values of game entities based on physical token detection, the method being implemented in a computer system comprising one or more physical processor and storage media storing machine-readable instructions, the method comprising:

executing instances of a virtual space and implementing the instances of the virtual space to facilitate participation by users in the virtual space via computing platforms associated with the users, user participation including controlling game entities associated with the users within the virtual space, individual game entities defined by attribute values of appearance attributes and ability attributes, such that a first user participates in a first instance of the virtual space via a first computing platform associated with the first user by controlling a first game entity within the first instance of the virtual space, wherein the first game entity is currently defined at least in part by a first attribute value of a first appearance attribute and a second attribute value of a first ability attribute;

detecting tokens based on signals received from token readers, a first token reader being communicatively coupled with the first computing platform, individual tokens being standalone physical objects, the tokens including a first token, the first token being detectable based on a first signal conveying information associated with the first token;

obtaining attribute modification information based on signals received from token readers, the attribute modification information facilitating making changes from currently defined attribute values of the game entities, including obtaining first attribute modification information based on receiving a second signal, the first attribute modification information facilitating making changes from currently defined attribute values of the first game entity; and effectuating modifications from currently defined attribute values of game entity attributes responsive to attribute modification information being obtained, including effectuating a first modification responsive to the first attribute modification information being obtained, the first modification including a change from the first attribute value by a first amount, and from the second attribute value by a second amount.

12. The method of claim 11, wherein currently defined attribute values comprise one or both of default attribute values or attribute values defined based on gameplay within the virtual space.

13. The method of claim 12, wherein individual groups of game entities are associated with an individual game entity type, wherein game entities of an individual game entity type are associated with a set of default attribute values, such that the first game entity and a second game entity are of a first game entity type, and wherein the first game entity and second game entity are associated with the same set of default attribute values.

14. The method of claim 11, wherein attribute modification information is stored by the tokens and conveyed by signals received from the token readers, such that the second signal conveys the first attribute modification information.

15. The method of claim 11, wherein attribute modification information is stored in a location other the tokens, such that the first attribute modification information is obtained from a storage location that is not associated with the first token.

16. The method of claim 15, wherein the second signal conveys information used to look-up the first attribute modification information from the storage location.

17. The method of claim 11, wherein the modifications are effectuated in real-time responsive to attribute modification information being obtained.

18. The method of claim 11, wherein attribute values of appearance attributes define one or more of color, surface texture, special visual effects, or virtual clothing associated with individual game entities.

19. The method of claim 11, wherein attribute values of ability attributes define one or more abilities of individual game entities within the virtual space.

20. The method of claim 19, wherein the second attribute value of the first ability attribute of the first game entity specifies a first level of a first ability of the first game entity, and wherein the first attribute modification information specifies an increase in the level of the first ability by the second amount, such that the second attribute value is changed to a first modified attribute value that specifies a second level of the first ability that is greater than the first level by the first amount.

* * * * *